United States Patent [19]

Ottersbach

[11] 4,302,649

[45] Nov. 24, 1981

[54] SELF-RETAINING ELECTRICAL TERMINAL

[75] Inventor: Thomas V. Ottersbach, St. Louis County, Mo.

[73] Assignee: Emerson Electric Co., St. Louis, Mo.

[21] Appl. No.: 82,768

[22] Filed: Oct. 9, 1979

[51] Int. Cl.[3] ..... H01H 1/00
[52] U.S. Cl. ..... 200/284; 200/303
[58] Field of Search ..... 200/284, 303

[56] References Cited

U.S. PATENT DOCUMENTS

| | | | |
|---|---|---|---|
| 3,689,723 | 9/1972 | Ludwig | 200/284 |
| 3,786,209 | 1/1974 | Bury | 200/284 |
| 3,805,005 | 4/1974 | Wilkinson et al. | 200/284 |
| 4,025,738 | 5/1977 | Erwin et al. | 200/284 |
| 4,095,073 | 6/1978 | Frank | 200/303 |

*Primary Examiner*—John W. Shepperd
*Attorney, Agent, or Firm*—Polster, Polster and Lucchesi

[57] ABSTRACT

A self-retaining electrical terminal readily insertible into a slot provided in a switch housing or the like which is positively retained in its slot by means of a retaining tab which self locks with the housing upon insertion of the terminal into its slot.

5 Claims, 6 Drawing Figures

SELF-RETAINING ELECTRICAL TERMINAL

BACKGROUND OF THE INVENTION

This invention relates to a self-retaining electrical terminal which may be readily installed in a slot in a switch housing or the like during assembly of the switch and which self locks in the housing so as to prevent removal of the terminal.

Heretofore in the assembly of switches, such as starting switches for fractional horsepower induction motors or the like, having a number of terminals for connection of various electrical circuits thereto, it was conventional for the terminals to be manually positioned within corresponding slots or openings in one half of the switch housing. In general, these prior terminals, including the terminals carrying the switch arms and the fixed electrical contacts for the switch, were only loosely held in their respective slots in the housing parts prior to assembly of the housing parts (i.e., the terminals were not positively secured to their housing parts). Upon assembly of the switch housing, the housing halves or parts would cooperate with one another so as to hold or secure the terminals within their respective slots. However, during the manufacture of the switch, the switch terminals could become displaced from their slots prior to the complete assembly of the switch. Also, in certain instances, the terminals of the prior art switches were only loosely held within their housing even after assembly of the housing thus permitting certain movement of the contacts and switch arms with respect to the housing. This wiggling of the switch terminals could in turn result in improper actuation of the switch resulting in intermitent electrical contact. Also, prior to assembling the switch housing, the loosely held terminals could become displaced or lost from the housing thus resulting in an improperly assembled switch. Still further, the loosely held switch parts could not be function-tested prior to assembly of the switch. If improper operation of the switch was detected, it necessitated the disassembly of the switch.

Among the several objects and features of the present invention may be noted in the provision of a switch assembly in which the various terminals, contacts, and switch arms thereof are readily inserted into the switch housing and are securely held in place prior to the final assembly of the switch thus preventing a loss of loose switch parts;

The provision of such a switch assembly in which the terminals are securely retained against removal;

The provision of such a switch assembly in which the switch contacts, terminals, and switch arms are positively retained in the switch housing and they are positively restrained against movement with respect to the housing so as to prevent wiggling of the switch terminals;

The provision of such a switch assembly in which the functionality of the switch can be determined prior to assembly of the switch; and The provision of such a switch assembly which is of rugged and economical construction and which is reliable in operation.

Other objects and features of this invention will be in part apparent and in part pointed out hereinafter.

SUMMARY OF THE INVENTION

Briefly stated, the present invention is intended for use in a switch assembly housing a housing molded of suitable, electrically insulative, synthetic resin material, the housing having a plurality of electrical terminals securable in-place within the housing for making or breaking one or more electrical circuits. Each of these terminals is made of a suitable electrically conductive sheet metal alloy and has a body portion and connection portion. The connection portion is adapted to be electrically connected to one of the above-said electrical circuits. A portion of the switch housing is adapted to receive the terminal body portion for securement in the housing and the connection portion of the terminal extends therefrom for connection to its respective electrical circuits. A plurality of slots, one for each terminal, is formed in the housing portion with each of the slots being a blind slot open at one side of the housing and being closed at the other side of the housing. Each of these slots has a relatively narrow portion for reception of the body portion of the terminal with the connection portion of the terminal extending exteriorily thereof. The slot further has an enlarged portion in communication with the narrow slot portion. The body portion of each of the terminals is receivable within the narrow portion of the slot and the retaining portion of the body portion of the terminal is received within the enlarged slot portion. The housing portion receiving the terminals has a base surface generally parallel to the narrow slot portion, this base surface constituting the base wall of the enlarged slot portion. The housing portion further has a pair of spaced side walls between the narrow slot portion and the base wall so as to form side walls for the wide slot portion. The retaining portion of the terminal has a retaining tab bent out of the plane of the terminal and the terminal is insertable in sidewise direction into the slot with the planar body portion of the terminal being received in the narrow slot portion and with the retaining tab being received within the wide slot portion. The retaining tab has a width somewhat less than the distance between the side walls of the wide slot portion thereby to substantially prevent movement of the terminal out of the slot in the plane of the narrow slot portion. Further, the retaining tab has a length greater than the depth of the enlarged slot portion from the narrow portion of the base wall. The retaining tab is bent out the plane of the terminal so that, upon insertion in sidewise direction into the wide slot portion, the retaining tab is engagable with the base wall and is resiliently deformed thereby so that the free end thereof forceably engages the base wall thereby to retaining of the terminal within the slot on the attempted withdrawal of the terminal in opposite sidewise direction.

BRIEF DESCRIPTION OF THE DRAWINGS

Corresponding reference characters indicate the corresponding parts throughout the several views of the drawings.

DESCRIPTION OF THE PREFERRED EMBODIMENTS

Figure 1:
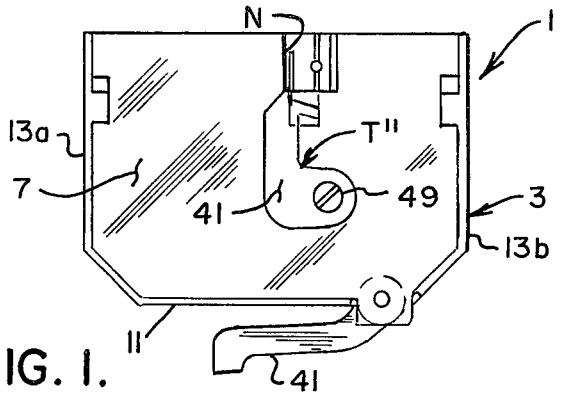
FIG. 1 is a front elevational view of the switch assembly of the present invention having a cover installed in place on a switch housing with a grounding terminal installed in the switch assembly.
Figure 2:
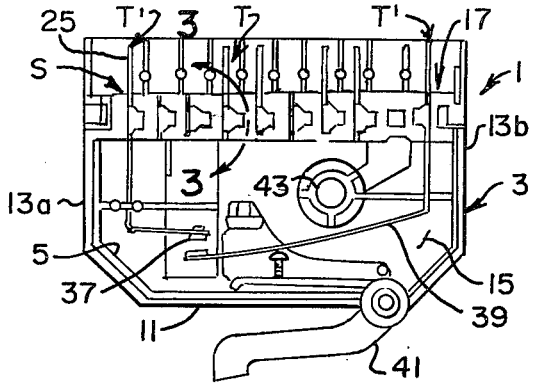
FIG. 2 is a view similar to FIG. 1 illustrating the switch assembly with the cover and the grounding terminal removed therefrom.

Referring now to the drawings, a switch assembly of this invention is indicated in its entirety by reference character 1 and it is shown to include a housing 3 molded of a suitable synthetic resin, electrical insulative material. Housing 3 has a space 5 (see FIG. 2) therewithin for containing the operative parts of the switch which will be hereinafter explained. A removable cover 7 (see FIGS. 1 and 4) overlies one face of the housing and together with the housing encloses space 5. The housing has a bottom wall 11, side walls 13*a* and 13*b*, and a back wall 15 (see FIG. 2) opposite cover 7. The top of the housing is open and a terminal receiving portion or gusset, as is generally indicated at 17, is molded within the housing so as to extend between side walls 13*a* and 13*b* and thereby to close the front of space 5. Gusset 17 has a plurality of blind slots 5 molded therein for receiving and holding a plurality of terminals, as generally indicated at T, one terminal being received in each slot S.

More specifically, each slot S is a blind slot open at the open side of gusset 17 adjacent cover 7 and closed at the opposite side thereof adjacent back wall 15. Each of the slots is a relatively narrow portion 19 and an enlarged or wide portion 21 (see FIGS. 3 and 4) for purposes as will appear.

Figure 5:
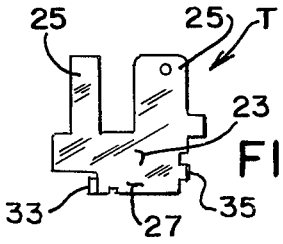
FIG. 5 is a front elevation view of a common electrical terminal adapted to be inserted into the switch housing.
Figure 6:
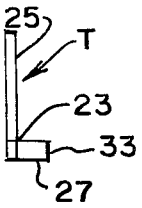
FIG. 6 is a side elevation view of the terminal shown in FIG. 5.

Referring now more particularly to FIGS. 3–6, each terminal T is shown preferably to be a one piece member formed of suitably electrically conductive sheet metal (e.g., a suitable brass alloy or the like). Generally, each terminal has a body portion 23 and a connection portion 25. Body portion 23 of each terminal is adapted to be received in its respective slot S and terminal portion 25 of each terminal is adapted to extend out beyond gusset 17 toward the open end of the housing for connection to a plug (not shown) including a number of female receptacles for the electrical connection of the terminals of the switch to predetermined electrical circuits or wires. As best shown in FIG. 6, body portion 23 is generally planar and the thickness of the sheet metal from which the terminal is fabricated is selected so as to permit it to readily be received in the narrow portion 19 of slot S, but yet to be firmly held in place therewithin. Body portion 23 further has a retaining portion 27 which is received within enlarged slot portion 21.

Enlarged slot portion 21 of each slot S is shown to be defined by a base wall 29 in gusset 17 opposite narrow slot portion 19 and a pair of side walls 31*a*, 31*b*. Of course, the enlarged slot portion 21 is in communication with the narrow slot portion 19. Base wall 29 is shown to be generally parallel to the narrow slot portion.

Retaining portion 27 of terminal T is shown to include a self-locking or self-retaining tab 33 integral with body portion 23 and bent out of the plane thereof. Tab 33 has a width w (see FIG. 3) and approximately the same as (preferably only slightly less than) the spacing between side walls 31*a* and 31*b*, as indicated by W, of enlarged slot portion 21. Thus, with the terminal inserted in slot S, tab 33 cooperates with side walls 31*a*, 31*b*, so as to snugly hold the terminal in the slot and to substantially hold the terminal against movement (e.g., wiggling) in the plane of narrow slot portion 19.

Figure 3:
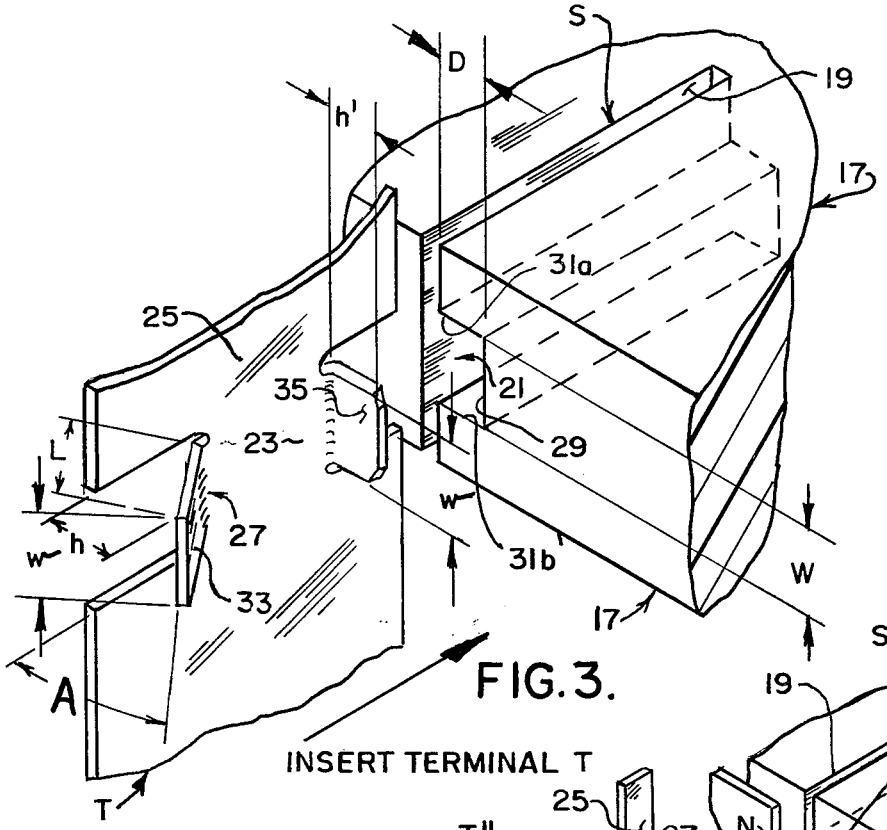
FIG. 3 is a greatly enlarged view of a portion of the switch housing taken on line 3—3 of FIG. 2 illustrating a slot formed in this last-said portion of the switch housing and also a portion of an electrical terminal adapted to be inserted in the slot.
Figure 4:
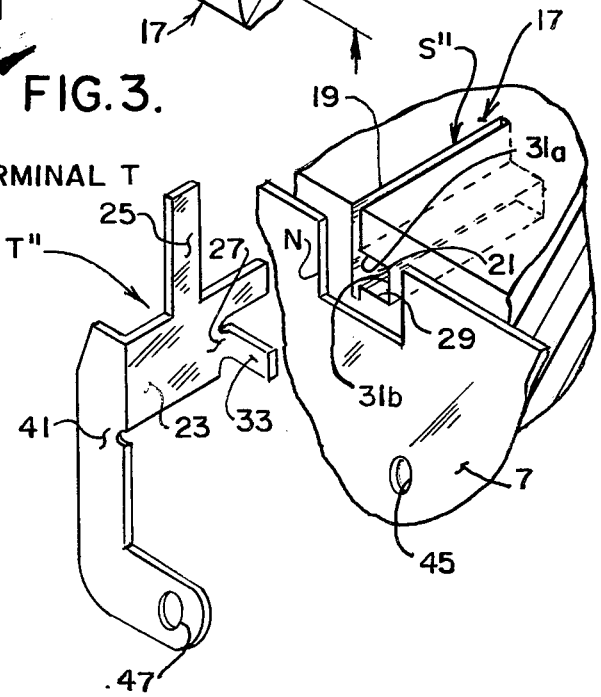
FIG. 4 is a view similar to FIG. 3 (but on a smaller scale) illustrating the construction of a grounding terminal prior to its insertion into the switch housing.

Further, retaining tab 33 is of a length L (i.e. the distance from its free end to its attachment to body portion 23) greater than the depth D of enlarged slot portion 21 from narrow slot portion 19 to base wall 29. Further in accordance with this invention, the retaining tab 33 is bent out of the plane of the body portion 23 so as to have a height h greater than the depth D of enlarged slot portion 21. As shown in FIG. 3, the tab is bent at an acute angle A (e.g., about 45 degrees). In FIG. 4, however, tab 33 is shown to be bent at an angle generally perpendicular to body portion 23. Thus, upon insertion of terminal T into its respective slot S (as indicated by the direction of the arrow shown in FIG. 3), the outer end of tab 33 interferes with base wall 29 and is resiliently forced inwardly toward body portion 23. Preferably, the sheet metal from which terminal T is fabricated is resilient and thus the retaining tab 33 is forcefully biased outwardly so that the free end of the tab resiliently engages base wall 29. Upon the attempted movement of terminal T in the direction opposite to the arrow in FIG. 3, the outer end of tab 33 will forceably dig into base wall 29 so as to positively prevent the withdrawal of the terminal from slot S. Also, because tab 33 resiliently bears against base wall 29, slop or wiggling of the terminals relative to the switch housing is substantially eliminated.

Terminal T is, in accordance with this invention, optionally provided with another tab 35 (see FIG. 3) for aiding in locating the terminal in the wide slot portion 21. More specifically, auxiliary tab 35 is integral with terminal T and has a height h' slightly less than the depth D of the enlarged slot portion and thus the outer end of the auxiliary tab is clear of base wall 29. Further, auxiliary tab 35 has a width w approximately equal to the width of the tab 33 so that both of the tabs are slightly less than the width W of slot portion 21. Thus, tab 35 aids in locating the terminal within slot S and thereby prevents wiggling of the terminal relative to the housing.

Terminals T shown in FIGS. 5 and 6 are the so-called common terminals having a pair of connection portions 25 extending outwardly from the body portion of the terminal so as to enable the electrical connections to be made thereto and to permit these electrical connections to be made common to one another.

As indicted at T', other terminals may be provided in switch assembly 1 with these other terminals carrying either switch contacts 37 or a movable switch arm 39. Generally, terminals T' are similar to terminals T heretofor described in that they have body portion 23 and connection portions 25 enabling them to be inserted in and self-retained in slots S in the manner heretofor described. However, these terminals T' also carry contacts 37 and switch arms 39 within chamber 5. Switch arm 39 is movable within the housing in response to movement of an actuator arm 41 from an open position (as shown in FIG. 3) in which the electrical contacts of the switch are open and a closed position (not shown).

It will be understood that an advantage of the switch of the present invention is that terminals T' carrying contact 37 or switch arm 39 can be inserted into their respective slots S in housing 3, that the contacts and the switch arm are positively held in place with respect to the switch housing, and that the functionality of the switch (i.e., the operation of the switch contacts) may be checked prior to the complete assembly of the switch. Also, it will be appreciated because the self-retaining and self-locking features of terminal T′ of the present invention, that wiggling or slop in the mounting of the terminals T′ is substantially eliminated thus fixing the switch arm relative to its stationery contacts 37, and thus eliminating inadvertent making and breaking of the switch contacts as may be caused by jiggling of the terminals relative to the housing.

Referring now to FIG. 4, still another embodiment T″ of the terminal of the present invention is shown. T″ is shown to constitute a grounding terminal installable in the switch housing after terminals T and T″ have been installed in the switch housing and after cover 7 has been snapped in place so as to enclose the open side of the switch housing. Cover 7 is provided with a notch N in register of the opening to a slot S″ adapted to receive grounding terminal T″. As shown in FIG. 4, grounding terminal T″ has a body portion 23 and a connection portion 25 generally similar to that heretofor described. Body portion 23 has a self-retaining tab 33 bent out of the plane thereof and adapted to be received in the wide slot portion 21 of slot S″. The terminal further has a grounding lug 41 extending out of the plane of body portion 23 and adapted to lie on the exterior of cover 7. Housing 3 has a grounding screw receiving receptacle 43 (see FIG. 2) molded-in-place therewithin and cover 7 has a hole 45 (see FIG. 4) therewithin adapted to be in register of the opening of the screw receiving receptacle 43. Terminal T″ has a corresponding opening 47 in its grounding lug 41 so that with the terminal installed in its respective slot S″ hole 47 aligns with the hull 45 in cover 7. Thus, a self-tapping screw 49 (see FIG. 1) may be inserted through hole 47 in the grounding plug and to engage receive the interior of plug 43 for the electrical connection of a grounding lead (not shown) to grounding terminal T″. Thus, and it will be appreciated that grounding terminal T″ may be inserted into the switch after assembly of the switch including assembly of cover 7 and the grounding lead to the switch may be connected to the switch on the exterior thereof after cover 7 has been installed on the switch. It will be appreciated that with grounding terminal T″ in place, cover 7 is positively retained on housing 3.

In view of the above, it will be seen that the several objects of this invention are achieved and that other advantageous results obtained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. In a switch assembly comprising a housing molded of a suitable, electrically insulative, synthetic resin material and having a plurality of electrical terminals securable in place within said switch housing for corresponding electrical circuits, each of said terminals being of suitable electrically conductive sheet metal or the like and having a body portion and a connection portion, said connection portion being adapted to be electrically connected to said electrical circuits, wherein the improvement of this invention comprises: a portion of said housing being adapted to receive said terminal body portion for securement in said housing, said connection portion extending therefrom for connection to said electrical circuits, a plurality of slots, one for each terminal, formed in said housing portion, each of said slots having a relatively narrow portion for reception of said body portion of said terminal with said connection portion extending outwardly therefrom and an enlarged portion in communication with said narrow portion, the body portion of each of said terminals being generally planar and being receivable within said narrow slot portion and a retaining portion receivable within said enlarged slot portion, said housing portion having a base surface for each slot generally parallel to said narrow slot portion and constituting the base wall of said enlarged slot portion and a pair spaced side walls between said narrow slot portion and base wall of each slot so as to form side walls of said wide slot portion, said retaining portion of said body portion having a retaining tab bent out of the plane of said body portion, and a second tab bent out of the plane of said body portion, said second tab being spaced from said retaining tab, said terminal being insertable in sidewise direction into said slot with said planar body portion of said terminal being received in said narrow slot portion and with said retaining tab and said second tab being received within said wide slot portion, said retaining tab and said second tab each having a width somewhat less than the spacing between said side walls of said wide slot portion thereby to substantially prevent movement of said terminal relative to said slot in the plane of said narrow slot portion, said retaining tab having a height from the body portion of said terminal to the outer end of said terminal greater than the depth of said enlarged slot portion from said narrow slot portion to said base wall, said retaining tab, upon insertion in sidewise direction into said wide slot portion, being engageable with said base wall and being resiliently deformed thereby so that the free end thereof forceably engages said base wall for retaining the terminal therewithin upon the attempted withdrawal of the terminal in opposite sidewise direction.

2. In a switch assembly as set forth in claim 1 wherein said second tab is clear of the base wall of said wide slot portion.

3. In a switch assembly as set forth in claim 1 wherein said retaining tab is bent out of the plane at an acute angle, the free end of the retaining tab being spaced from the plane of the terminal a distance greater than the depth of the wide slot portion.

4. In a switch assembly as set forth in claim 1 wherein said housing is open at one side thereof for insertion of said terminals in sidewise direction into their respective said slots, said slots being blind slots open only at said one side of said housing, said switch including a cover installable after installation of said terminals on said open side of said housing for closing of said open side, said cover having a notch therein in registration with one of said slots in said housing, one of said terminals constituting a ground terminal being installable in said one slot after installation of said cover, said ground terminal having a ground terminal portion extending from said body portion of said terminal and being disposed on the exterior of said cover for electrical connection to a ground lead or the like.

5. In a switch as set forth in claim 4 wherein said switch housing is adapted to receive a grounding fastener, said cover having a screw opening therein so as to permit the reception of said grounding screw in said housing, said ground terminal portion having an opening therethrough in register with said screw opening in said cover whereby said grounding screw may be inserted through said screw opening in said ground terminal and in said cover and be received within said housing.

* * * * *